US007167158B2

(12) United States Patent
Silverbrook

(10) Patent No.: US 7,167,158 B2
(45) Date of Patent: Jan. 23, 2007

(54) SCANNING ELECTRONIC BOOK

(75) Inventor: Kia Silverbrook, Balmain (AU)

(73) Assignee: Silverbrook Research Pty Ltd, Balmain (AU)

( * ) Notice: Subject to any disclaimer, the term of this patent is extended or adjusted under 35 U.S.C. 154(b) by 51 days.

(21) Appl. No.: 10/487,839

(22) PCT Filed: Aug. 29, 2002

(86) PCT No.: PCT/AU02/01165

§ 371 (c)(1),
(2), (4) Date: Feb. 27, 2004

(87) PCT Pub. No.: WO03/019338

PCT Pub. Date: Mar. 6, 2003

(65) Prior Publication Data

US 2004/0239601 A1 Dec. 2, 2004

(51) Int. Cl.
*G09G 5/00* (2006.01)

(52) U.S. Cl. ..... 345/156; 345/901; 382/313

(58) Field of Classification Search ..... 345/1.1, 345/1.3, 87, 173, 156–157, 901–903; 382/321, 382/313, 315; 380/51; 235/435, 462.09, 235/462.11, 462.1

See application file for complete search history.

(56) References Cited

U.S. PATENT DOCUMENTS 5,153,928 A * 10/1992 Iizuka ..... 382/321
5,159,635 A 10/1992 Wang
5,243,655 A 9/1993 Wang
5,288,980 A 2/1994 Patel et al.
5,541,396 A * 7/1996 Rentsch ..... 235/454
5,764,774 A * 6/1998 Liu ..... 380/269
5,825,947 A 10/1998 Sasaki et al.
6,052,117 A 4/2000 Ohara et al.
6,095,418 A 8/2000 Swartz et al.
6,107,988 A 8/2000 Phillipps
6,176,427 B1 * 1/2001 Antognini et al. ..... 235/454
6,182,899 B1 * 2/2001 Muller et al. ..... 235/475
6,188,385 B1 2/2001 Hill et al.
6,236,442 B1 5/2001 Stephenson et al.
6,268,840 B1 7/2001 Huang
6,498,597 B1 12/2002 Sawano
6,512,497 B1 1/2003 Kondo et al.
6,786,420 B1 * 9/2004 Silverbrook ..... 235/494

FOREIGN PATENT DOCUMENTS

EP 0388204 A 12/1997
GB 2345558 A 7/2000
GB 2349716 A 11/2000
JP 2001-100667 A 4/2001
WO WO 87/23819 A 7/1997

* cited by examiner

*Primary Examiner*—Regina Liang

(57) ABSTRACT

An electronic book for presenting text and/or graphics includes a scanner for scanning data cards bearing a pattern encoding the text and/or graphics. The electronic book further includes a programmed processor for decoding the text and/or graphics and a screen for displaying same. In a preferred embodiment the electronic book is provided in a compact foldable housing with an appearance similar to a conventional book including a flexible and foldable screen. The housing includes a spine having a recess to allow the folded screen to loop without damage occurring due to creasing.

15 Claims, 9 Drawing Sheets

SCANNING ELECTRONIC BOOK

CROSS REFERENCE TO RELATED APPLICATIONS

The present application is a 371 of PCT/AU02/01165 filed on Aug. 29, 2002, which is a continuation of U.S. application Ser. No. 09/942,602 filed Aug. 31, 2001.

BACKGROUND OF THE INVENTION

1. Field of the Invention

The present invention relates to an electronic book or "e-book" being a device that presents text and/or graphics, for example the text of a book or magazine and associated pictures, upon an electronic screen. Such devices typically comprise a display screen, for example an LCD screen under control of a programmed microprocessor. The microprocessor reads data from a data storage medium such as a Micro-CD-ROM or memory card such as a PCMIA card and converts the data into text and/or graphics that are displayed on the LCD screen.

2. Description of Related Art

One commercially available electronic book is the REB1100 available from RCA. That device has a monochrome LCD touch screen and a built in 33.6 kbps v.34 capable modem that allows digital book data to be downloaded from a remote database into an onboard 8 MB memory.

In U.S. Pat. No. 6,229,502 there is described an electronic book which is configured to read digital book data from a ROM such as a PCMIA card.

In U.S. Pat. No. 6,037,954 to McMahon there is described an electronic book which includes a Micro-CD-ROM drive for reading digital book data encoded onto a Micro-CD-ROM.

One problem with these devices is that they rely on data storage or distribution systems which are relatively expensive and complex to implement.

BRIEF SUMMARY OF THE INVENTION

It is an object of the present invention to provide an electronic text and/or graphics presentation device that is capable of reading book data encoded on a low cost, high capacity medium that may be conveniently carried.

According to the present invention there is provided an electronic text and/or graphics presentation device including:

scanning means arranged to scan a pattern encoding text and/or graphics;

a user input control means;

processing means coupled to the scanning means and responsive to the user input control means and operatively programmed to generate a data signal corresponding to the text and/or graphics; and a display means controlled by the processing means and arranged to display the text and/or graphics in response to the processing means.

In order that the device be compact it preferably includes a foldable housing comprising first and second housing portions pivotal relative to each other.

According to the preferred embodiment the first and second housing portions are each pivotally connected to a common spine.

Batteries for powering the unit may be conveniently located in a battery compartment formed in the spine.

It is desirable that the pattern be formed on a card and said device includes a roller mechanism arranged to retract the card into said device.

In the preferred embodiment the roller mechanism is incorporated into the first housing portion.

In order for a user of the device to readily determine if the device is loaded with a card the first portion may include a window for observing cards retracted into the first portion.

Preferably the device includes a card storage magazine which may be located in the second portion.

The display means may comprise a flexible LCD screen that is located across inner surfaces of the first and second housing portions.

In order to reduce power consumption it is advantageous that the flexible LCD screen be of a bi-stable type.

Preferably the housing includes a recess, for example formed in the spine, for receiving a loop of the LCD screen upon pivoting the first and second housing portions to a closed position in order that creasing of the LCD screen is avoided.

In order to allow for a compact construction it is preferred that first and second printed circuit boards are located in the first and second housing portions respectively.

The flexible LCD screen may include conductive traces coupling the first and second printed circuit boards to each other.

In the preferred embodiment the user input control means comprises a joystick assembly.

According to a further aspect of the present invention there is provided an electronic text and/or graphics presentation device including:

a scan head arranged to scan a pattern corresponding to text and/or graphics;

a processor coupled to the scanner and configured to generate data corresponding to the text and/or graphics;

a display screen responsive to the processor and arranged to display the text and/or graphics.

According to a final aspect of the present invention, there is provided a method for distributing text and/or graphics comprising the steps of:

encoding the text and/or graphics as a printed pattern on a plurality of cards;

distributing the cards to a plurality of users;

providing each of the users with an electronic text presentation device including means arranged to scan one of said cards and convert said pattern into readable text.

DETAILED DESCRIPTION OF THE PREFERRED EMBODIMENT

The drawings illustrate an electronic book that is configured to read data encoded as a pattern printed on a sheet of card.

Figure 1:
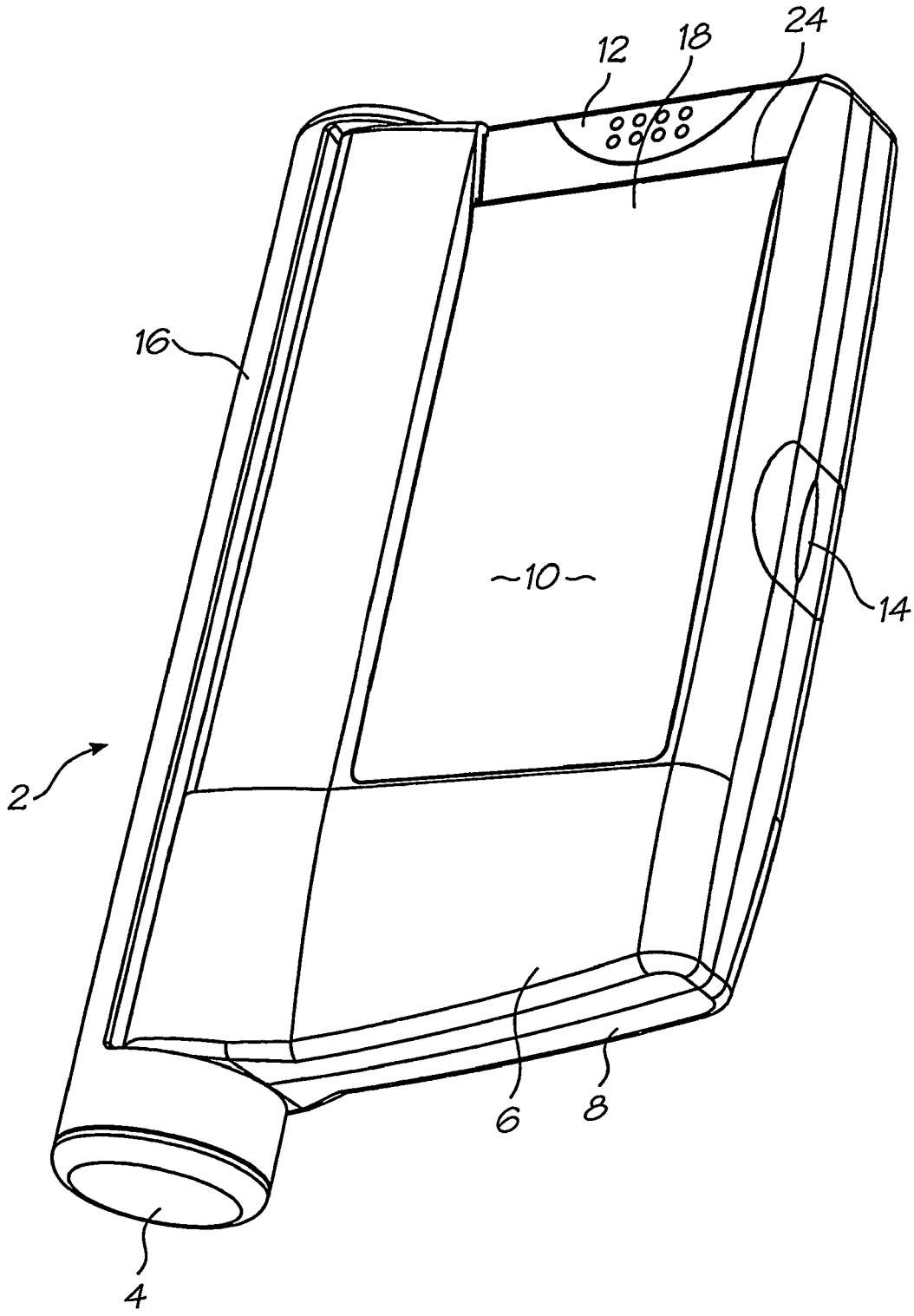
FIG. 1 is a first perspective view of an apparatus according to a preferred embodiment of the present invention.
Figure 2:
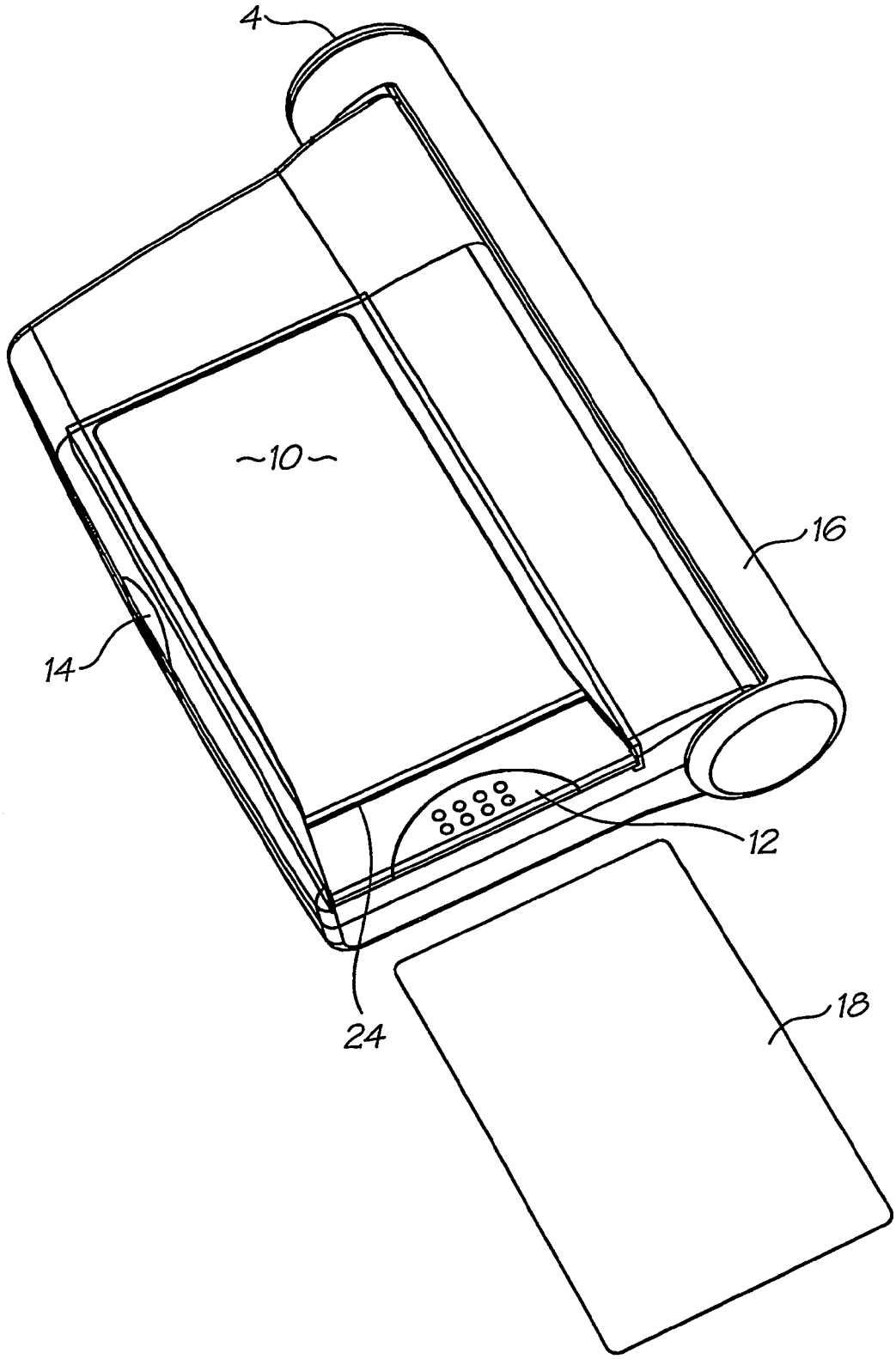
FIG. 2 is a second perspective view of the apparatus.
Figure 5:
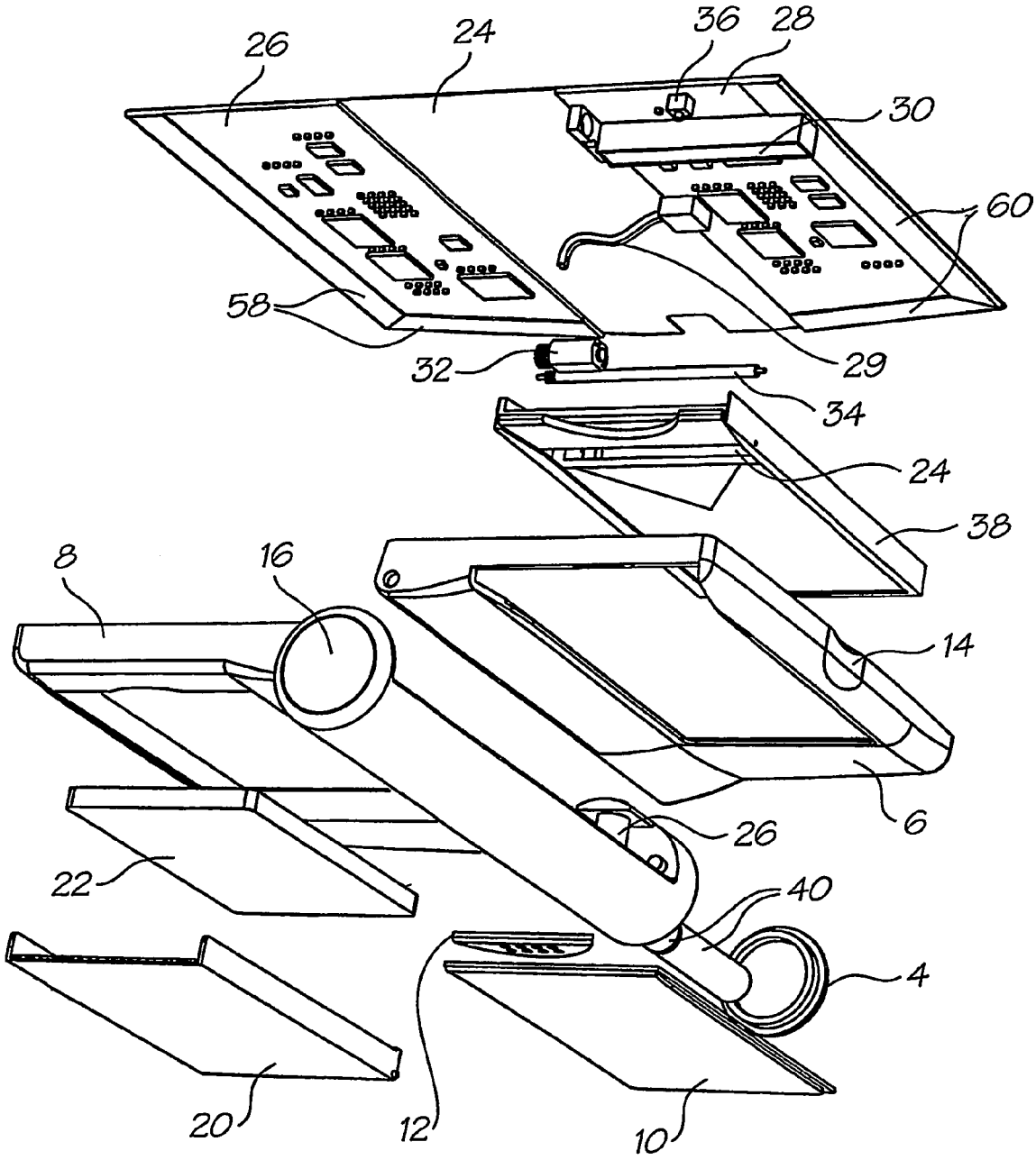
FIG. 5 is an exploded perspective view of the apparatus.

With reference to FIGS. 1 and 2, there is depicted a view of the front of an electronic book or "e-book" 2 according to a preferred embodiment of the invention. The e-book has a foldable housing including first and second housing portions in the form of front door 6 and a rear door 8 each pivotally connected to a spine 16. A clasp 14 holds the two doors closed when the e-book is not being used. The outside of the front door 6 features a clear window 10 through which a data card 18 is visible. The data card is inserted under the window through a card slot 24 and is engaged by a roller and fed into an internal cartridge 38 (FIG. 5). On one side of the data card there is printed information for a user to read such as the title and author of a book. Accordingly a user of the e-book is able to determine at a glance the content that the e-book is loaded with. The text of the book is encoded as a pattern on the reverse side of the data card.

At the top of the outside of front door 6 there is located an eject button 12. Upon operation of the eject button, card 18 is ejected from the e-book by the internal roller mechanism.

At the base of spine 16 there is located a battery cover 4 that covers a battery compartment for accommodating two AAA size batteries that power the e-book.

Figure 3:
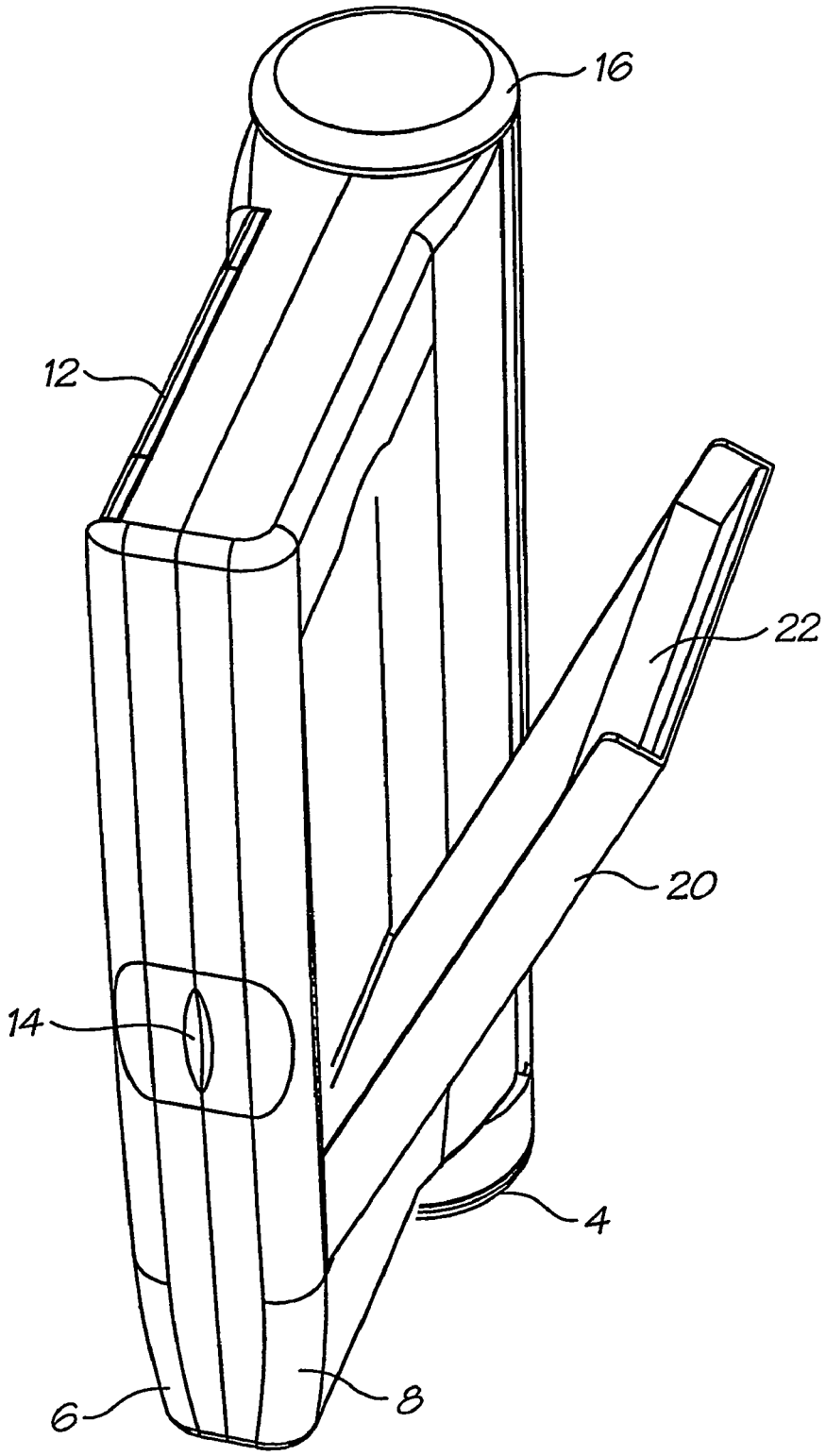
FIG. 3 is a third perspective view of the apparatus.

The outside of rear door 8 is visible in FIG. 3. Storage magazine 20 is hinged to swing out from rear door 8 to a position, as shown, where data cards 22 may be stored or selected for removal and insertion into card slot 24.

Figure 4:
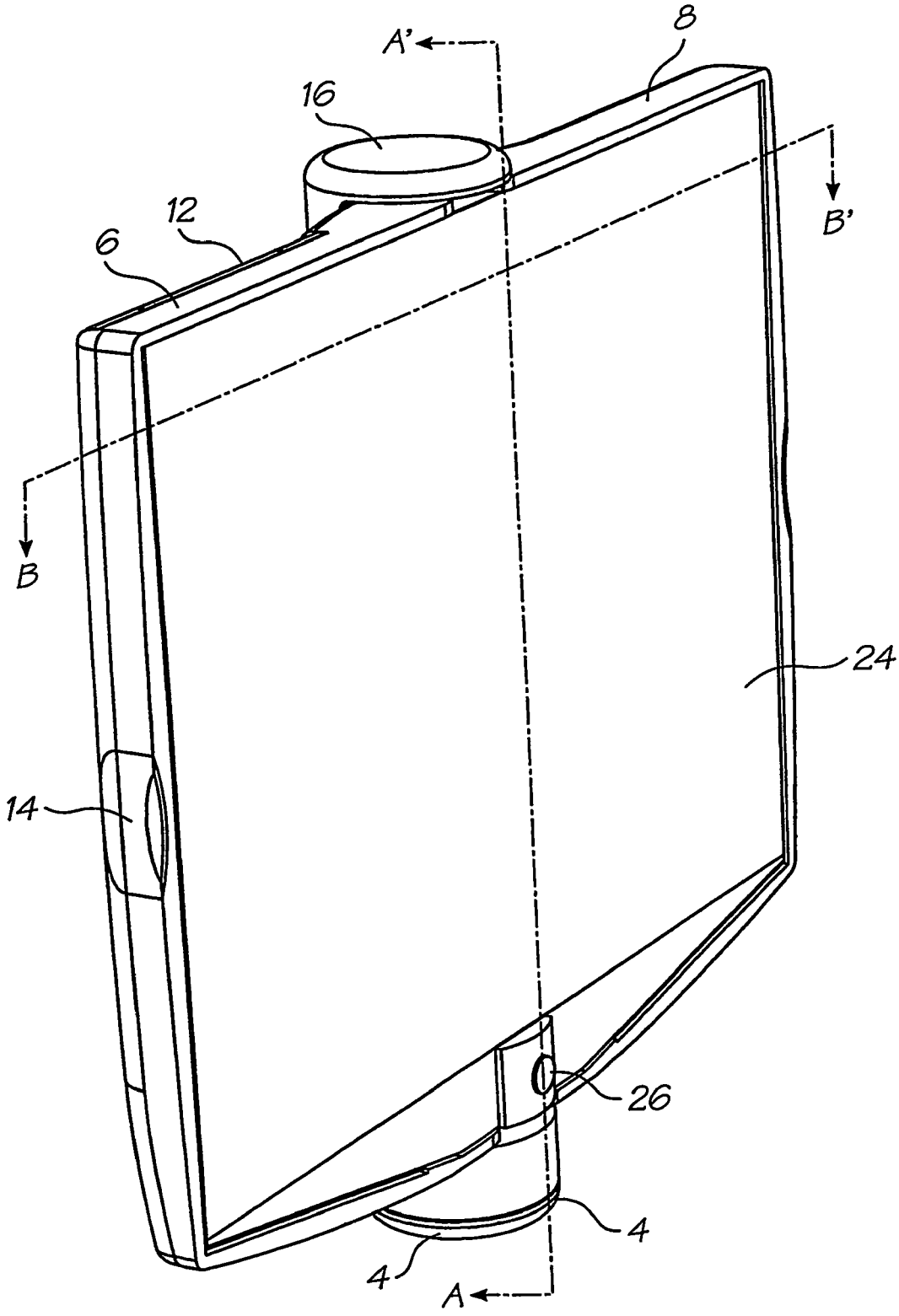
FIG. 4 is a perspective view of the apparatus shown open for use.

FIG. 4 shows the e-book with the front and rear doors swung about spine 16 to an open position. In that position a flexible LCD screen 24 is visible. It is preferred that a VGA resolution monochrome screen be used being a passive bi-stable reflective polymer doped liquid crystal (PDLC) display fabricated on a flexible polymer substrate. By using a bi-stable screen power consumption is reduced as the screen draws zero current while presenting a static image.

The LCD screen operatively displays the text of the book encoded on card 24. A user of the e-book is able to control which page of text is presented by means of joystick 26.

The internal arrangement of the e-book may be comprehended by referring to FIG. 5 which is an exploded view. It will be noted that on the underside of LCD 24 there are located two PCBs 26 and 28. PCB 28 has mounted directly upon it a scanner head 30. The PCBs 26 and 28 are loaded with various electronic components including a microprocessor, RAM and ROM memory chips and power supply conditioning circuitry. It is envisaged that a VLIW microprocessor and accompanying circuitry, as described in U.S. patent application Ser. No. 09/113,053 and hereby incorporated by reference in its entirety, be used. PCBs 26 and 28 communicate by means of conductive traces on the back of flexible LCD 24. The conductive traces terminate in peripheral contact regions 58 and 60 of the LCD screen which are folded over the edges of the PCB's to form connections with contact pads on the PCBs.

Figure 6:
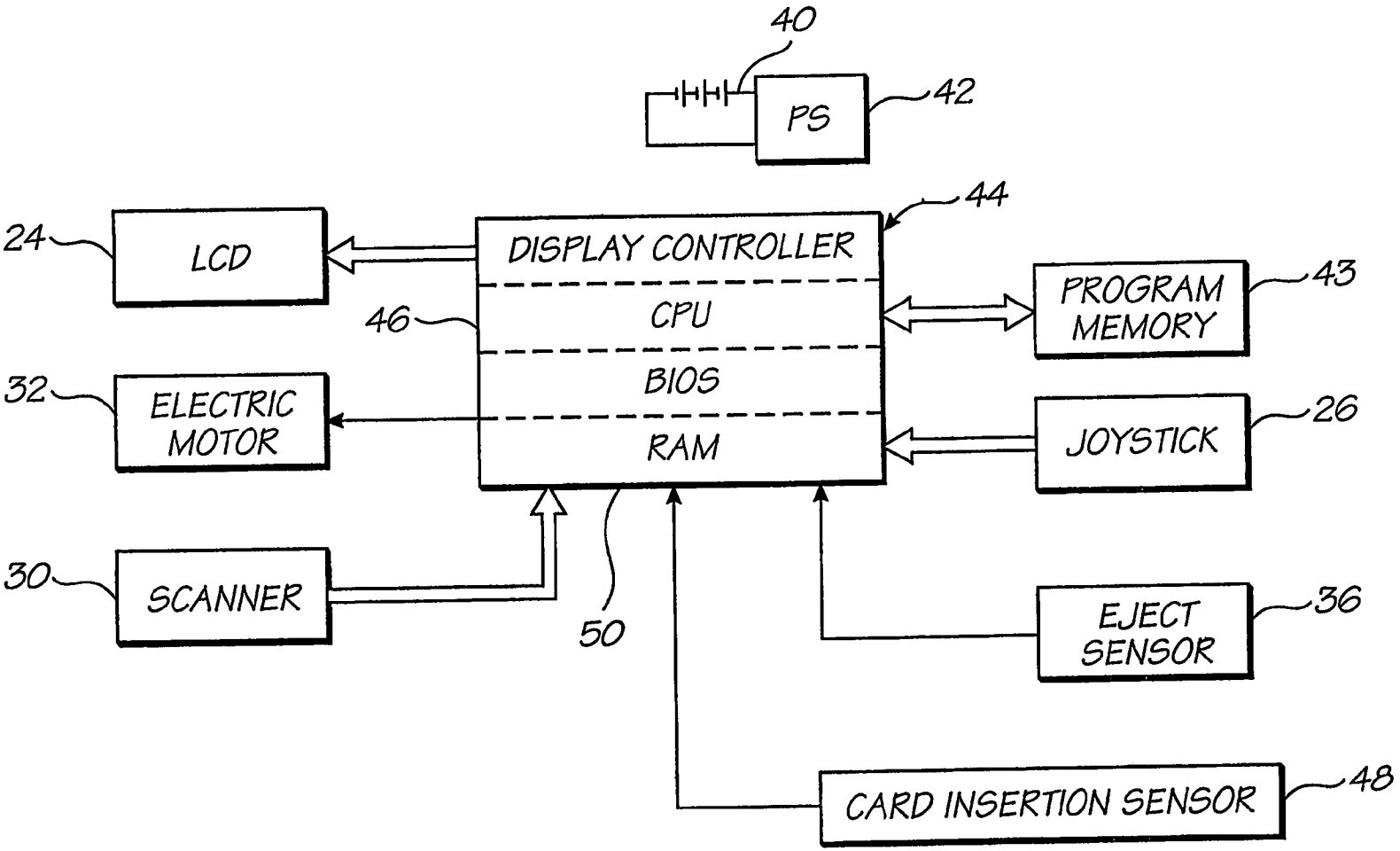
FIG. 6 is a system block diagram of the apparatus.

Adjacent scan head 30 there is located a motor 32 which drives roller 34 via reduction gearing. A switch 36 is provided to detect depression of eject button 12. FIG. 6 provides a further exploded view internal cartridge 38 and window 10.

Power for the electric motor and various circuit modules is conveyed from a battery compartment in the spine of the e-book to PCB 28 by means of cable 29.

A block diagram of various electronic components of the e-book is shown in FIG. 6. Power from batteries 40 is conditioned and distributed by power supply circuit 42 to the various circuit modules located on the PCBs. To extend battery life, the processor circuitry is powered down whenever the screen display is constant. Near zero power consumption allows the e-book to appear to always be "on" in the manner of a conventional paper based book.

Processing module 44 includes a central processing unit 46, which communicates with BIOS memory chip 48 and RAM 50 in the conventional manner. The CPU operates according to a program stored in program memory chip 52. The processing module receives data and control signals from eject sensor 36, joystick 26 and scanner 30. In a further, more complex implementation, LCD screen 24 may be touch sensitive in which case the processing module would also be responsive to command signals generated by a user touching the LCD screen.

In operation a book data card is inserted through card slot 24. In response card insertion sensor 48 generates a signal alerting processing module 44 to activate electric motor 32 thereby causing roller 34 to draw the card into internal cartridge 38. As the card is drawn in scan head 30 converts a pattern on the card into corresponding data signals which are decoded by CPU 46 according to an algorithm implemented in the software stored in program memory chip 52. The resulting decoded text file is stored in RAM 50.

The decoded signals are displayed as readable text on LCD 24 under control of display controller 44. Of course, as referred to previously, in magazines and some books, such as childrens' books, technical volumes and manuals, illustrations or graphics may feature prominently. Accordingly, the software stored in program memory chip 52 may also include instructions to decode figures encoded on the book data card.

The processing module 44 is responsive to signals generated by joystick 26 and is programmed to allow a user to move forward or backwards through the displayed text. In particular, processing module 44 retrieves different data segments from RAM 50 in response to movement of the joystick.

Several systems for encoding the data cards are appropriate and have been described in the prior art. For example, in U.S. Pat. No. 6,176,427 there is described a method for coding digital data, such as a text file, into a pattern printable on an A4 or Letter size piece of paper. In the system that is described it is possible to encode slightly more than 1 MB of data on to one side of a printed letter size page of paper using a high resolution printer and a 600 dpi scanner. In the presently described preferred embodiment the scanner head 30 is implemented by means of the scan head technology described in the previously incorporated U.S. patent application Ser. No. 09/113,053 Such a scanner has an output resolution of 4800 dpi.

It is further envisaged that the data card be produced using the very high resolution print heads described in the previously referred to U.S. patent application Ser. No. 09/113,053. Accordingly the amount of data that may be stored on a data card of dimensions 8.5 cm×5 cm (3.5"×2") is approximately 1 Mb. Encoding of the text on to the data card may be performed as described in U.S. patent application Ser. No. 09/112,781 which is hereby incorporated by reference in its entirety.

Accordingly an entire novel may be stored on a single credit card sized plastic card by means of a pattern formed as an array of 16 million printed ink dots. The manufacturing cost per card is less than 1 cent, or about one fiftieth the cost of manufacturing a floppy disk. While it is envisaged that the card be made of plastic it would also be possible to use other substrates such as paper.

While it is primarily envisaged that the data stored on the data card will correspond to the text of a book or magazine, it is also possible to encode an executable program file. Accordingly updates to the software program stored in program memory 43 may be conveniently distributed in the form of encoded data cards.

Figure 7:
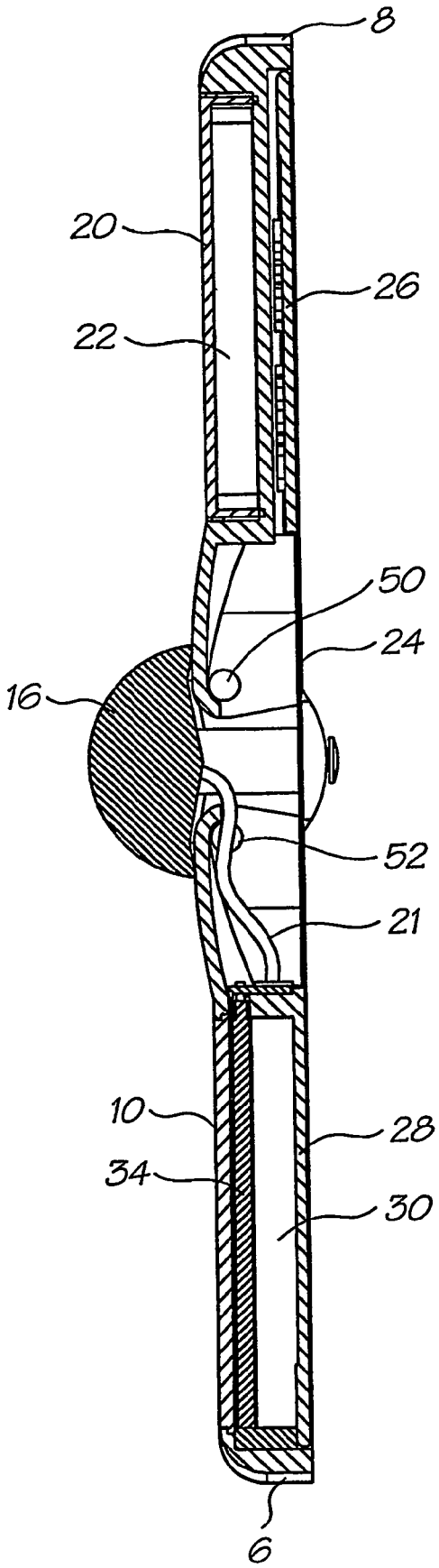
FIG. 7 is a cross sectional view of the apparatus open and through line B–B' of FIG. 4.

The mechanical arrangement of the e-book will now be described further with reference to FIG. 7 where it will be noted that front door 6 and rear door 8 are independently pivoted about hinges 50 and 52. Power cable 29 is deliberately left slack to accommodate movement of the front door 6 during closure of the book. It will be noted that the spine 16 and outer surfaces of the front and rear doors are configured so that upon fully opening the e-book the flexible LCD screen is drawn taught and flat for convenient viewing.

Figure 8:
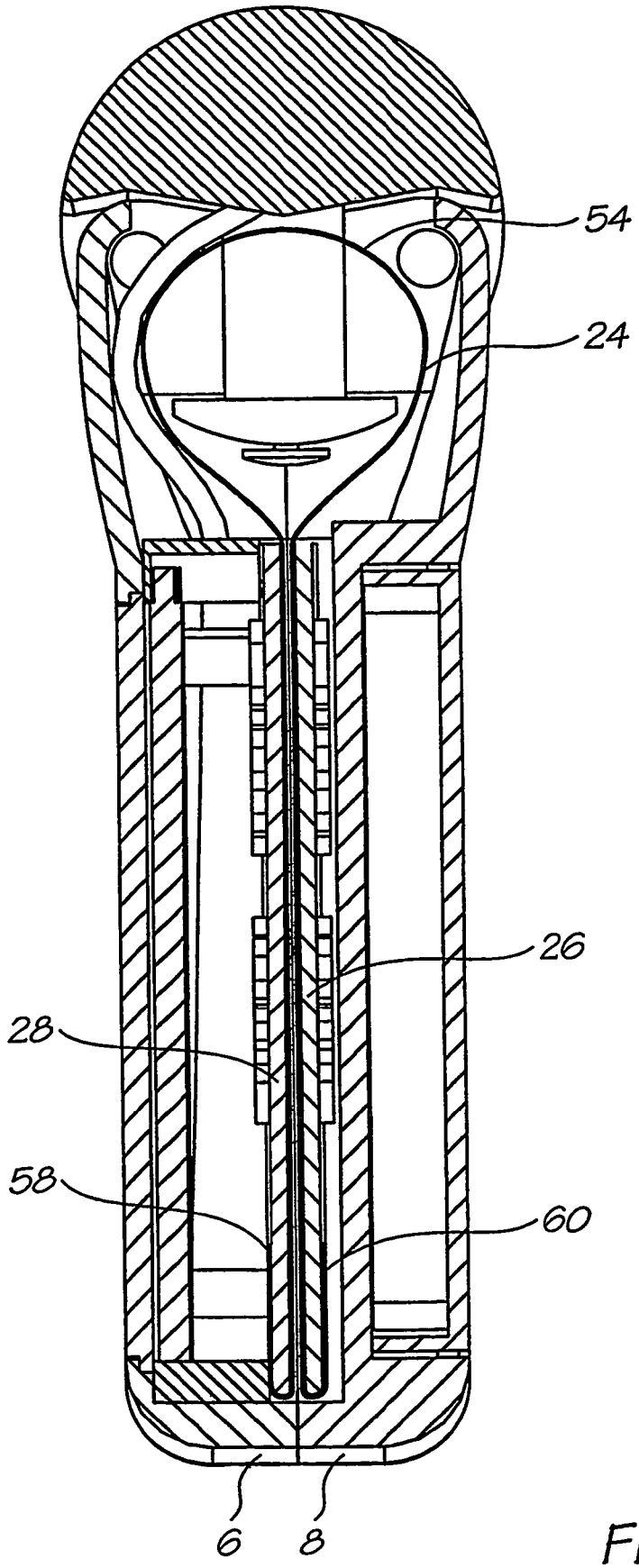
FIG. 8 is a cross sectional view of the apparatus closed and through line B–B' of FIG. 4.

A further cross sectional view of the e-book, with doors 6 and 8 brought to a closed position appears in FIG. 8. It will be noted that in the closed position a mid portion 54 of the flexible LCD screen 24 is able to loop into the spine by virtue of a recess formed in the spine for and front and rear doors for receiving the screen. Consequently creasing and damage of the LCD screen is avoided.

Also visible in FIG. 8 are screen-to-PCB contact areas 58, 60 which respectively connect the underside of the PCB to the outer edges of each of PCBs 26 and 28. As previously explained, conductive traces on the underside of the PCB provide a path for the PCBs to exchange power and data signals.

Figure 9:
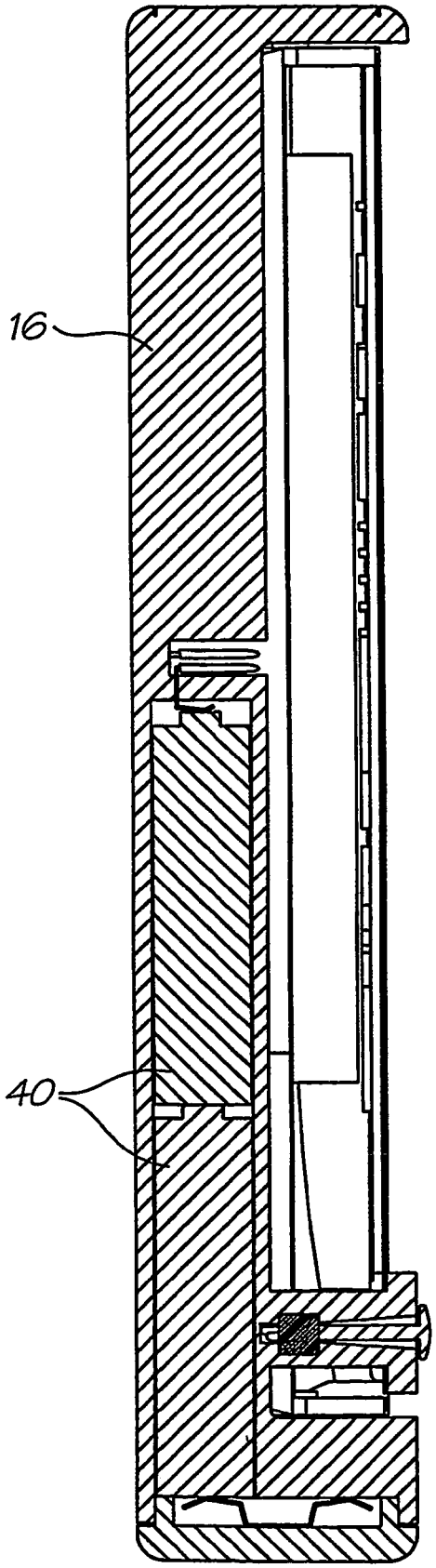
FIG. 9 is a cross sectional view of the apparatus through line A–A' of FIG. 4.

A further cross-sectional view is provided in FIG. 9 through the long axis of spine 16 showing two AAA batteries located in a battery compartment formed in the spine. As will be realized by those skilled in the art, embodiments of the invention other than the preferred embodiment described in detail herein are possible. Accordingly the following claims are not to be read as limited by the preferred embodiment.

The invention claimed is:

1. An electronic text and/or graphics presentation device including:

scanning means arranged to scan a card having a pattern printed as an array of dots encoding text and/or graphics;

a user input control means;

processing means coupled to the scanning means and responsive to the user input control means and operatively programmed to generate a data signal corresponding to the text and/or graphics;

a display means controlled by the processing means and arranged to display the text and/or graphics in response to the processing means; and a housing in which the scanning, unset input control, processing and display means are housed, the scanning means being arranged to scan the card when the card is at a scanning position within the housing, the housing having a window for observing user information on the card when the card is at the scanning position.

2. An electronic text and/or graphics presentation device according to claim 1 wherein the housing foldable and comprises first and second housing portions pivotal relative to each other.

3. An electronic text and/or graphics presentation device according to claim 2, wherein the first and second housing portions are each pivotally connected to a common spine.

4. An electronic text and/or graphics presentation device according to claim 3, wherein the spine includes a battery compartment.

5. An electronic text and/or graphics presentation device according to claim 1, further including a roller mechanism arranged to retract the card into the housing to said scanning position.

6. An electronic text and/or graphics presentation device according to claim 2, wherein the first housing portion has a roller mechanism arranged to refract the card into the housing to said scanning position.

7. An electronic text and/or graphics presentation device according to claim 1, including a card storage magazine.

8. An electronic text and/or graphics presentation device according to claim 2, wherein the second housing portion has card a storage magazine.

9. An electronic text and/or graphics presentation device according to claim 2, wherein to display means comprises a flexible LCD screen located across inner surfaces of the first and second housing portions.

10. An electronic text and/or graphics presentation device according to claim 9, wherein the flexible LCD screen is bi-stable.

11. An electronic text and/or graphics presentation device according to claim 3, including a recess for receiving a loop of a flexible LCD screen upon pivoting the first and second housing portions to a closed position in order that creasing of the LCD screen is avoided.

12. An electronic text and/or graphics presentation device according to claim 2 wherein first and second printed circuit boards are located in the first and second housing portions respectively.

13. An electronic text and/or graphics presentation device according to claim 12, wherein the flexible LCD screen may include conductive traces coupling the first and second printed circuit boards to each other.

14. An electronic text and/or graphics presentation device according to claim 1, wherein the user input control means comprises a joystick assembly.

15. An electronic text and/or graphics presentation device including:

a scan head arranged to scan a card having a pattern printed as an array of dots encoding text and/or graphics;

a processor coupled to the scan head and configured to generate data corresponding to the text and/or graphics;

a display screen responsive to the processor and arranged to display the text and/or graphics; and a housing in which scan head, processor display screen are housed, the scan head being arranged to scan the card when the card is at a scanning position within the housing, the housing having a window for observing user information on the card when the card is at the scanning position.

* * * * *

UNITED STATES PATENT AND TRADEMARK OFFICE

CERTIFICATE OF CORRECTION

PATENT NO. : 7,167,158 B2
APPLICATION NO. : 10/487839
DATED : January 23, 2007
INVENTOR(S) : Kia Silverbrook It is certified that error appears in the above-identified patent and that said Letters Patent is hereby corrected as shown below:

Column 6, line 17 (claim 6) should read:
--a roller mechanism arranged to retract the card into the--

Column 6, line 20 (claim 7) should read:
--according to claim 1, further including a card storage magazine.--

Column 6, line 25 (claim 9) should read:
--according to claim 2, wherein the display means comprises a--

Signed and Sealed this

Fifteenth Day of January, 2008

JON W. DUDAS
*Director of the United States Patent and Trademark Office*